United States Patent [19]

Iwasaki et al.

[11] 4,159,000

[45] Jun. 26, 1979

[54] METHOD FOR SOOTLESS COMBUSTION AND FURNACE FOR SAID COMBUSTION

[75] Inventors: Yosimi Iwasaki, Date; Yukimitu Yamada; Noboru Watanabe, both of Sapporo, all of Japan

[73] Assignee: Hokkaido Sugar Co., Ltd., Tokyo, Japan

[21] Appl. No.: 849,941

[22] Filed: Nov. 9, 1977

[30] Foreign Application Priority Data

Dec. 27, 1976 [JP] Japan ..... 51-156474

[51] Int. Cl.[2] ..... F23G 5/00

[52] U.S. Cl. ..... 110/244; 110/258; 110/259; 110/346

[58] Field of Search ..... 110/244, 258, 259, 263, 110/264, 346

[56] References Cited

U.S. PATENT DOCUMENTS

| | | | |
|---|---|---|---|
| 2,242,653 | 5/1941 | Maxwell | 110/244 |
| 2,614,513 | 10/1952 | Miller et al. | 110/244 |
| 3,848,550 | 11/1974 | Bowen | 110/244 |
| 3,855,951 | 12/1974 | Giles | 110/244 |
| 3,889,608 | 6/1975 | Pitt | 110/244 |

FOREIGN PATENT DOCUMENTS

| | | | |
|---|---|---|---|
| 989248 | 5/1976 | Canada | 110/244 |

*Primary Examiner*—Kenneth W. Sprague
*Attorney, Agent, or Firm*—Oblon, Fisher, Spivak, McClelland & Maier

[57] ABSTRACT

Air is blown into a combustion furnace via an inlet disposed in the upper section of the furnace and the incoming air is made to flow in a fixed spirally descending path along the inner wall of the furnace proper. Material subjected to combustion is carried by the flow of air to the layer of burning material at the bottom of the furance by previously deposited combustible material, there to be burnt. By virtue of the action of the current of air, the combustion gas from the combustion is vigorously whirled upwardly in the same rotational direction as that of the air current in the annular region defined by the fixed path of the spirally descending air current. This ascending current of air is enclosed within the annular region defined by the descending current. While the combustion gas is thus being whirled upwardly, the solid particles such as soot and other products of incomplete combustion which are entrained by the ascending combustion gas are caused by centrifugal force to pass into the spirally descending air flow. Therefore, by the time the waste gas from the combustion is finally released from the combustion furnace into the ambience, it is substantially free from soot and dust.

9 Claims, 7 Drawing Figures

METHOD FOR SOOTLESS COMBUSTION AND FURNACE FOR SAID COMBUSTION

BACKGROUND OF THE INVENTION

1. Field of the Invention

This invention relates to a method of combustion which minimizes the generation of soot and dust as possible sources of air pollution and also to a combustion furnace used in practicing such method.

2. Description of the Prior Art

Combustion of solid materials such as rice hulls, tree bark, wood chips and shavings and peanut shells which have high carbonaceous fiber contents produces large volumes of furnace dust. The furnace dust arising from the combustion consists preponderantly of fine carbon particles which include soot, carbon skeletons resulting from combustion of carbonaceous matter and ashes occurring as incombustible residues. Although the occurrence of the first two types of furnace dust can be eliminated by enhancing the completeness of combustion, the production of ashes due to incomplete combustion cannot be thoroughly avoided. Ashes issuing from furnace have to date been captured at furnace outlets by various methods to prevent their dispersion into the atmosphere. For example, waste gases from combustion furnaces have been discharged into the atmosphere after they have been freed from furnace dust by treatments with scrubbing and precipitators using liquid agents or treatments with precipitators making effective use of gravitation, inertial force or centrifugal force.

SUMMARY OF THE INVENTION

An object of this invention is to provide a method for combustion which minimizes the possible escape of furnace dust in the combustion of solid substances such as rice hulls, tree bark, wood chips, peanut shells and fruit rinds and seeds which have high carbonaceous fiber contents and a combustion furnace for effecting such method.

Another object of the present invention is to provide a method for combustion which provides constantly stable combustion of the materials and permits easy control of the temperature and volume of the waste gas from the combustion and a combustion furnace for effecting, such method.

Still another object of this invention is to provide an economical furnace for combustion requiring no auxiliary fuel.

To accomplish the objects described above according to the present invention, there is provided a method for combustion which comprises continuously blowing air and combustible material into the upper section of a cylindrical furnace body, having a flue opening into the center part of the ceiling therof, in a tangential direction relative to the furnace body thereby forming a downflowing helical stream of air and combustible material in the vicinity of the inner wall of the furnace body, causing the air in the downflowing helical stream to strike the floor of the furnace, and collect toward the center of the furnace and then reverse its direction of flow to ascend toward the flue opening through the space enclosed by the downflowing helical stream while swirling in the same direction as the downflowing helical stream. The combustible material in the downflowing helical stream is thus caused to strike the floor of the furnace and be carried into and burned together with a layer of burning material formed at the bottom of the furnace by previously deposited combustible material, causing the combustion gas to ascend together with the ascending air toward the flue opening through the space enclosed by the downflowing helical stream while swirling in the same direction as the downflowing helical stream, causing the solid materials contained in the combustion gas to be hurled into the downflowing helical stream by centrifugal force and to be carried back to the layer of burning material, agitating the layer of buring material to cause the lower part of the layer of burning material to be progressively discharged outside the furnace body, and maintaining the layer of buring material at a constant thickness.

In the present invention, the fixed spirally descending air current is constantly formed within an annular region adjoining the inner wall of the combustion furnace and the material subjected to combustion is carried to the layer of burning material formed at the bottom of the furnace by previously deposited combustible material by means of the air current as described above, with the result that the combustible material, during its spiral descent, is heated by contact with the ascending hot waste gas of combustion and progressively forms a fresh layer of burning material within the lower section of the furnace body. The direct delivery of the air current to the layer of burning material in the combustion furnace enhances the efficiency of combustion. While the combustion gas is in the process of ascending within the space enclosed by the annular region defined by the spirally descending path of air current, it is vigorously whirled by the gyrating force of the air current in the same rotational direction as that of the descending air current. And, by virtue of the centrifugal force resulting from the vigorous whirl of the combustion gas, the solid particles such as soot, products of incomplete combustion and ashes which are being entrained by the combustion gas are hurled outwardly into the descending air current, with the result that the combustion gas is freed of the solid particles by the time it is released into the ambient air. Since a constant current of air is kept between the spirally ascending path of the combustion gas and the inner wall surface of the combustion furnace while the combustion is in process, the wall surface of the furnace remains at a lower temperature than in the conventional combustion furnace. This means that the combustion furnace used in the present invention is less expensive than the conventional furnace in the sense that use of a smaller amount of refractory material suffices for its effective operation. The combustion by this method, therefore, requires absolutely no fuel such as gas or petroleum. The temperature and volume of the waste gas from the combustion to be released from the furnace can easily be controlled and uniformized by proper regulation of the volume of air and combustible material being introduced into the furnace interior and the volume of the burning material layer discharged outside the furnace body. The combustion gas can be effectively utilized as the source of heat in a separate drier or heat exchanger and, therefore, serves to contribute to the promotion of energy saving.

Other objects and characteristics of the present invention will become evident from the detailed description of the invention given hereinafter with reference to the accompanying drawings.

DETAILED DESCRIPTION OF THE PREFERRED EMBODIMENTS

Figure 1:
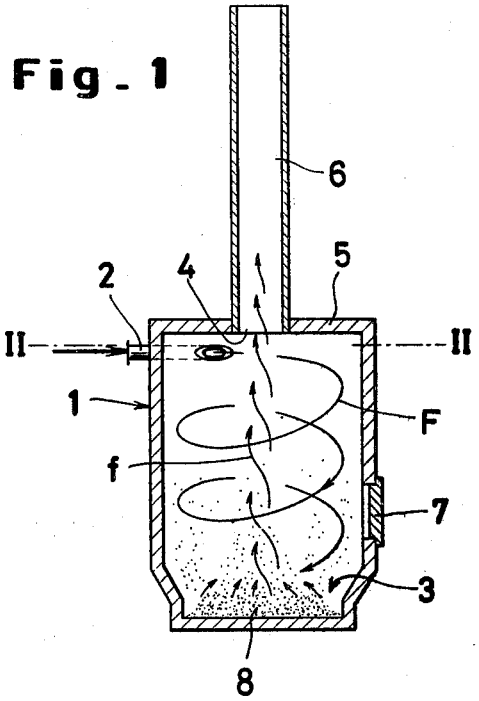
FIG. 1 is an explanatory diagram illustrating the principle of the combustion in the present invention.
Figure 2:
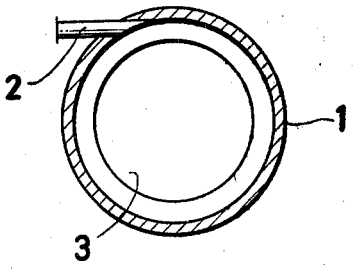
FIG. 2 is a sectional view taken along the line II—II of the combustion furnace of FIG. 1.

FIG. 1 is an explanatory diagram illustrating the principle of combustion which forms the basis of this invention. In the upper section of a cylindrical furnace proper 1, there is provided an air inlet 2. This air inlet 2 is disposed tangentially relative to the furnace proper 1 as illustrated in FIG. 2. The air inlet 2 has its opening formed along the inner wall of the furnace proper. The upper end of the furnace proper is covered with a lid 5 having an air outlet 4 at the center thereof, the opening of the outlet is substantially on the same plane as the lid and this air outlet 4 is connected to a flue 6. In the outer shell of the furnace proper, there is provided an inspection window 7 which permits direct visual observation of the condition of combustion within the furnace proper. The lower section of the furnace proper is formed in the shape of a funnel.

In the combustion furnace of a construction such as is described above, when air and a material subjected to combustion are continuously blown into the furnace interior through the air inlet 2, the current of air "F" descends spirally along the inner wall of the furnace. In other words, the spirally descending current of air "F" occupies an annular space adjoining the inner wall surface of the furnace. Entrained by the air current, the combustible material is also caused to descend spirally along the inner wall surface of the furnace. Since the lower section 3 of the furnace body is formed in the shape of a funnel, the diameter of the air current is gradually decreased toward the bottom of the furnace body. The cylindrical, spiral air current is guided as air for the combustion of the combustible material to the layer of burning material 8 formed at the bottom of the furnace body by earlier deposited combustible material. The combustible material is progressively deposited in a burning state on the layer of burning material. The combustion gas issuing from the layer 8 in conjunction with excess air flows along the axis of the furnace body in a spirally ascending current "f" to the air outlet 4. The current "f" of the gas mixture consisting of the combustion gas and the excess air ascends along the inside boundary of the annular region defined by the spirally descending air current "F." Because of the gyrating force exerted by the spirally descending air current, the ascending current of the gas mixture, while in the ascending motion, is vigorously whirled in the same rotational direction as that of the descending air current. Owing to the centrifugal force generated by the vigorous whirling of the gas mixture, the solid particles such as soot and products of incomplete combustion which are ascending in conjunction with the combustion gas are hurled out into the spirally descending air current, with the result that these solid particles are brought back into the funnel shaped lower section 3. In the funnel shaped lower section, those of the particles which are combustible are burned and those which are non-combustible are retained in the form of ashes at the bottom of the furnace. Through the air outlet 4, therefore, only the combustion gas which is totally free from solid particles such as soot and dust is released into the ambient air.

As is evident from the foregoing description, this invention causes the incoming air to form a spirally descending current along the inner wall surface of the furnace and the combustion gas to ascend spirally in a vigorous whirl along the inner boundary of the annular region defined by the spirally descending air current in the same rotational direction as that of the air current. By virtue of the centrifugal force generated by the vigorous whirl, the solid particles such as soot and products of incomplete combustion are hurled outwardly into the spirally descending air current, so that the combustion gas released from the furnace into the atmosphere is totally free from such solid particles. Further, since the spirally descending current of air and the spirally ascending whirl of the combustion gas make counterflow contact with each other in the axial direction of the furnace proper, the material carried by the spirally descending current of air en route to the funnel shaped lower section is dried and preheated by the heat of the combustion gas. Thus, such is partly burned during its descent to the combustion chamber and partly brought to a state ready to undergo combustion upon arrival at the funnel shaped lower section. The counterflow contact between the two currents, accordingly, proves to be advantageous. The combustion of the material proceeds more rapidly and more completely because the spirally descending current of air which is intended as the source of air for combustion is forceful enough for ample delivery of air to the interior of the funnel shaped lower section. Fresh combustible material is deposited as a source of fire on the layer of burning material 8 at all times. Accordingly, a burner is necessary only when the initially delivered portion of the combustible material is to be ignited upon arrival at the funnel shaped lower section interior and there is no need whatsoever for constantly keeping a burner within the funnel shaped lower section.

The material subjected to combustion within the funnel shaped lower section according to the present invention may be of any type insofar as it is capable of being carried by the spirally descending air current. Examples of materials suitable include rice hulls, peanut shells, bean pods and other cereal capsules, fruit rinds and seeds and wood chips and shavings. Besides, used tires and tree bark and other materials which have large dimensions can also be subjected to the combustion after they have been cut into pieces of a size small enough to be carried conveniently by said air current. If the material happens to be of a type containing moisture, it is dried and preheated en route to the combustion chamber and can be burnt without being given any special pretreatment. A liquid material such as a spent oil can also be burned easily when it is injected into the spirally descending air current.

The size of the combustion furnace may suitably be determined by the volume of material to be combusted and the amount of heat generated thereby. As for dimensions, the preferable ratio between the inner diameter of the furnace proper and the height of the same is 1:1-2, that between the inner diameter of the furnace proper and the inner diameter of the combustion chamber is 1:0.6-0.9 and that between the inner diameter of the furnace proper and the height of the funnel shaped lower section is 1:0.3-0.5. When the dimensions of the furnace are within these ranges, spirally descending air flow and spirally ascending combustion gas flow can be effectively generated by appropriately adjusting the amount of air blown into the furnace proper.

The embodiment of FIG. 1 is illustrated as possessing one common inlet for the supply of air and for the introduction of the material for combustion. When necessary, however, two separate inlets may be disposed in the upper section of the furnace proper, one to be used for the supply of air and the other for the introduction of the material. In the case of combustion furnaces of a large size, a plurality of inlets for the supply of air and for the introduction of the material for combustion may be disposed in the upper section of the furnace. In the particular case where the height of the furnace proper is very large in comparison with the inner diameter thereof, it is advantageous to have several inlets for the supply of air disposed at fixed intervals in the direction of the height of the furnace proper.

Figure 3:
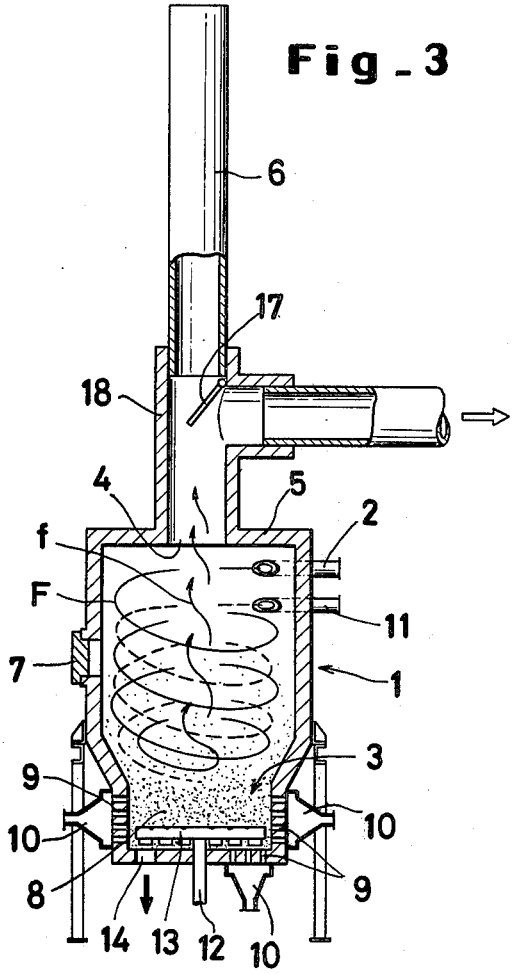
FIG. 3 is a sectional view of one embodiment of the combustion furnace according to the present invention.
Figure 4:
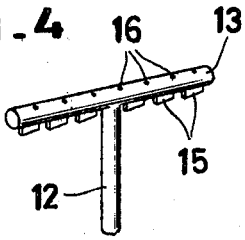
FIG. 4 is a perspective view of an agitation rod disposed inside a combustion chamber of the combustion furnace according to the present invention.
Figure 5:
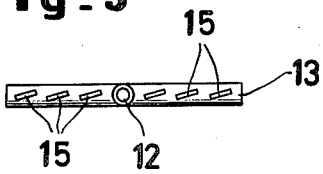
FIG. 5 is a bottom plan view of the agitation rod of FIG. 4.

FIG. 3 is a sectioned view of one embodiment of the combustion furnace according to the present invention. With reference to FIG. 3, the upper end of the cylindrical furnace proper 1 is covered with the lid 5 which contains an air outlet 4 at the center thereof. The lower section 3 of the furnace proper is of a funnel shape, and the layer of burning material is present within the funnel-shaped lower section. The funnel-shaped lower section is provided on its circular lateral side and the flat bottom side with a multiplicity of perforations 9 for supply of air for combustion. Inside the funnel-shaped lower section 3, an agitation rod 13 adapted to revolve on the bottom surface is supported in the middle by a rotary shaft 12 which is pierced axially through the bottom plate of the chamber. The rotary shaft 12 and the agitation rod 13 are formed of thermally resistant metal pipes. The agitation rod is provided, as illustrated in FIGS. 4 and 5, on the upper side thereof with a plurality of air injection orifices 16 and on the lower side thereof with agitation vanes 15. As this agitation rod 13 is revolved and air is injected through the orifices 16 in the rod, the revolving agitation rod serves to stir the material under combustion and the air jets serve to aid in the combustion and provide fresh air, bringing about a combined effect of accelerating the combustion. Besides, the revolution of the agitation rod serves an additional purpose of progressively raking the ashes piled in the lower part of the layer of burning material 8 and causing them to fall through an ash discharge outlet 14 disposed in the bottom plate of the furnace proper.

In the upper section of the furnace proper 1, an air inlet 2 is disposed in a tangential direction relative to the shell of the furnace proper so that the incoming air is allowed to flow in a spirally descending current along the inner wall surface of the furnace. An inlet 11 for introduction of the combustible material is disposed in the same tangential direction as that of the air inlet 2, so that it opens into the furnace interior directly below the air inlet 2.

In the operation of the combustion furnace of a construction such as is described above, a suitable amount of the material subjected to combustion such as, for example, rice hulls is introduced through the inlet 11 into the funnel-shaped lower section 3 and, subsequently, a piece of crumpled paper is ignited and thrown onto the pile of the material in the combustion chamber. Immediately, air for combustion is delivered through an aeration jacket 10 and introduced into the funnel-shaped lower section via the air orifices 9.

After confirmation has been made by visual observation through the inspection window 7 that a part of rice hulls have ignited, the revolution of the agitation rod 13 is started, the continuous supply of a high-speed air current through the air inlet 2 in the upper section of the furnace proper 1 is started and the continuous feeding of rice hulls through the inlet 11 for the introduction of the combustible material is simultaneously started. Consequently, the air is allowed to flow in a spirally descending current along the inner wall surface of the furnace proper and the rice hulls are entrained by the spirally descending air current. Upon arrival at the lower section of the furnace proper the air current is separated from the rice hulls and then is allowed to ascend from the center of the furnace to the outlet 4. On arrival at the lower section of the furnace proper, the rice hulls are burned as they are agitated by the agitation rod 13 in conjunction with the rice hulls already ignited, with the result that a layer of burning material 8 is formed. The ashes which collect in the lower part of the layer of burning material are raked by the vanes 15 of the agitation rod and are successively discharged through the ash discharge outlet 14.

Into the layer of burning material 3, rice hulls are successively delivered by virtue of the spirally descending air current "F." En route to the layer of burning material 3, the rice hulls are dried and partially carbonized by the heat emanating from the combustion gas current "f" which is ascending in a vigorous whirl like a tornado on the inside of the inner boundary of the descending air current. As soon as the rice hulls in such state arrive at the layer of burning material, they are ignited. Consequently, a layer of burning material of the intensity of white heat is continuously retained. Since the air current which has carried the rice hulls is continuously brought into the layer of burning material kept under such a condition, the gas issuing from the combustion is caused to ascend together with the flame in a vigorous whirl like a tornado around the axis of the furnace proper. The combustion gas, therefore, has intense heat and contains solid particles such as incompletely burned rice hulls and soot and is caused to ascend in a vigorous whirl around the axis of the furnace in the direction of the outlet 4. This spiral ascent of the combustion gas is forcibly accelerated by the gyrating force exerted by the spirally descending air current. The speed of this spiral motion of the combustion gas current is not degraded after the current has reached the upper section of the furnace. While the incompletely burned rice hulls are being entrained by the ascending current of combustion gas, a part of the rice hulls are burned by virtue of the vigorous whirl of the combustion gas current coupled with the intense heat and excess air accompanying the combustion gas and the remaining rice hulls, in conjunction with other solid particles such as soot, are hurled into the spirally descending air current by virtue of the centrifugal force exerted by the vigorous whirl and consequently brought back together with freshly supplied rice hulls into the layer of burning material 3, there to be burnt. Owing to the vigorous whirl which the spirally ascending current of combustion gas maintains during its motion toward the outlet 4, the solid particles entrained by this ascending current are substantially completely removed before they reach the outlet 4. As the combustion thus started in the furnace begins to proceed at a constant state, the rice hulls which are introduced through the inlet 11 and are entrained by the air current spirally descending along the inner wall surface of the furnace proper are dried, gasified, burned and carbonized by the radiant heat emitted from the furnace bottom and the furnace center. Then, the rice hulls thus exposed to the action of the radiant heat fall into the layer of burning material to undergo complete combustion. The ashes resulting from the combustion of rice hulls pile up and, during their combustion, the carbonized rice hulls tend more or less to assume a binding property and conglomerate but are prevented from the unwanted conglomeration by the agitation due to the revolution of the agitation rod 13 and the flow of the air jets. The residues of combustion occurring in the form of ashes are successively scraped off the lower layer by the vanes of the agitation rod and smoothly released through the ash discharge outlet. Thus, the layer of burning material is kept at a constant thickness.

The current of combustion gas which has been freed from the solid particles such as soot and products of incomplete combustion during its travel through the furnace interior is now ready for release into the atmosphere through the flue 6. Where the current of combustion gas is desired to be used as the source of heat for a drying unit (not shown), for example, the supply of the combustion gas to the drying unit can be accomplished by connecting the outlet 4 to a branched pipe 18 incorporating a switchable damper 17, with one of the remaining two ends of the branched pipe connected to the flue 6 and the other to the drying unit, and properly switching the damper 17 so as to forward the current of waste gas to the drying unit as occasion demands. Since the amount and temperature of the combustion gas to be supplied to the drying unit can easily be adjusted by regulating the amount of air being blown through the air inlet 2, it is rendered possible to feed the combustion gas at a fixed temperature and a fixed flow rate constantly to the drying unit without any difficulty. By this reason, the air inlet 2 and the inlet 11 for the introduction of the material for combustion are provided separately of each other in the present embodiment. When necessary, however, there may be disposed one inlet to be used concurrently for the supply of air and the introduction of the combustible material.

In the combustion of rice hulls by the conventional method, the combustion which follows the stage of carbonization proceeds at a low speed such that carbonized rice hulls ready for combustion accumulate in the furnance interior even to the extent of making desired continuous combustion difficult. In contrast in the combustion furnace of the present invention, the rice hulls are preparatorily dried and carbonized and thereafter subjected to combustion under ample supply of air as is understood from the foregoing explanation. The combustion of such rice hulls, therefore, proceeds smoothly at a high speed. Further, the residues of combustion are successively discharged out of the furnace interior. As the result, desired continuous combustion of rice hulls can be made to last over a great duration of time.

It is economically advantageous to utilize the combustion gas as the heat source in the drying unit for rice hulls because preferred preparatory drying of rice hulls can be obtained by entailing absolutely no consumption of a fuel of any sort at the same time that desired disposal of rice hulls is carried out.

Figure 6:
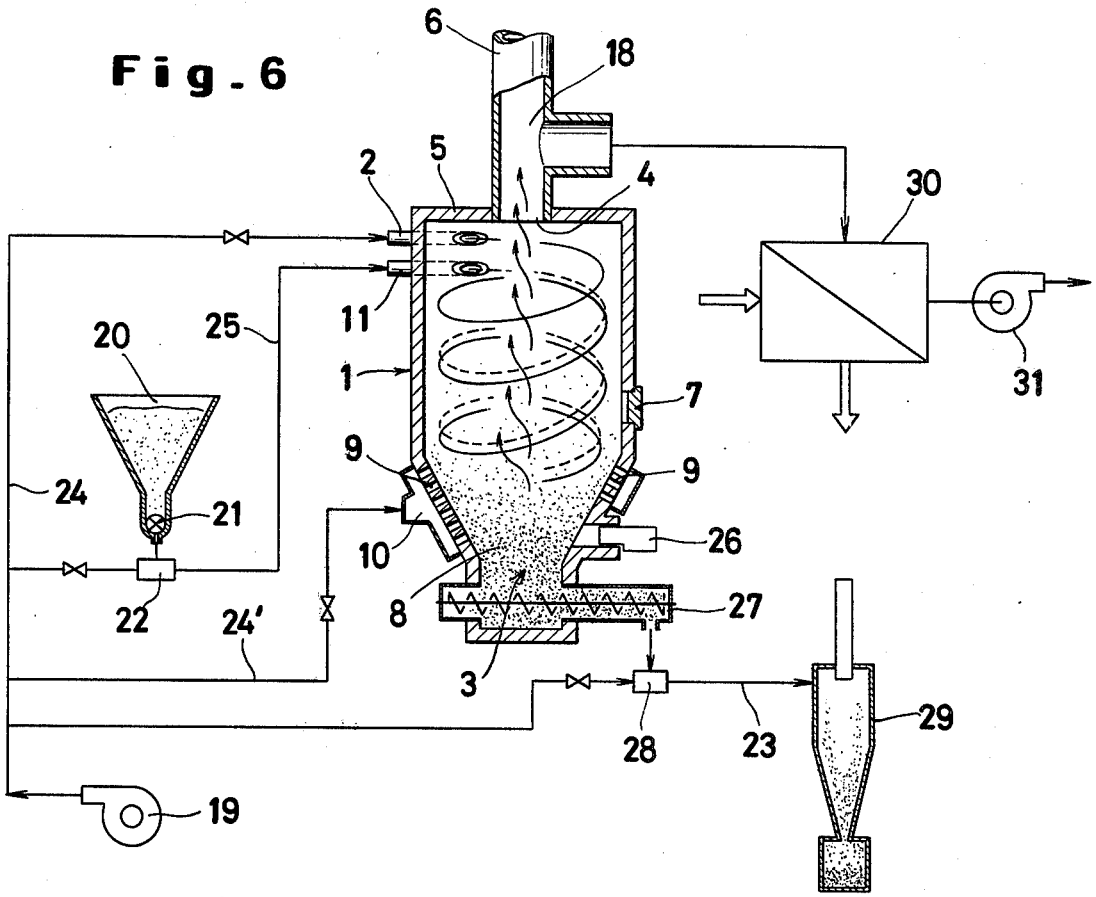
FIG. 6 is a sectional view illustrating in outline another embodiment of the combustion furnace according to the present invention and, FIG. 7 is a graph showing the relation between the time and temperature as determined during the combustion of rice hulls in the combustion furnace of the construction of FIG. 6.

The combustion furnace illustrated in FIG. 6 has basically the same construction as that of the combustion furnace of FIG. 3. The only difference resides in the fact that this combustion furnace is provided with means for automating the introduction of the combustible material, the supply of air and the discharge of the residue of combustion.

The particles of a small size subjected for combustion are placed in a hopper 20. They are continuously metered and fed by a rotary feeder 21 to an injection feeder 22 and are subsequently conveyed through a transfer pipe 25 to the inlet 11 in the furnace by a current of compressed air issuing from an air blower 19. The compressed air from the air blower 19 is separately forwarded through pipes 24, 24' respectively to the air inlet 2 and a jacket 10. The amounts of the compressed air thus forwarded can be adjusted by means of the valves incorporated in the respective pipes 24, 24'.

After a suitable amount of the particles is accumulated inside the lower section 3 of the furnace proper 3, it is ignited by a burner 26. After the particles have been ignited and the combustion thereof has proceeded to the point of giving rise to a layer of burning material 8 inside the lower section 3 of the furnace proper the burner is extinguished. From this point on, the same operation as involved in the aforementioned embodiment ensues. The combustible particles are entrained by the spirally descending air current are burned inside the layer of burning material and are deposited on the layer the combustion gas is caused to ascend in a vigorous whirl around the axis of the furnace toward the outlet 4 and the solid particles entrained by the combustion gas are separated by centrifugal force and allowed to return to the layer of burning material as entrained again by the spirally descending air current. The residues of the combustion are continuously discharged by a screw feeder 27 into an injection feeder 28. Then, they are forwarded through a pipe 23 to a cyclone 29 by means of the compressed air from the air blower 19.

The combustion gas which reaches the outlet 4 can be released in its unaltered form through the flue 6 into the atmosphere without any possibility of causing air pollution. Where the combustion gas is to be used as the heat source for the drying unit, space-heating system or water heater, for example, supply of a desired amount of the combustion gas to a heat exchanger 30 can be accomplished by connecting the outlet 4 to the heat exchanger 30 through the medium of a branched pipe 18 and then connecting the heat exchanger 30 to a blower 31 so as to permit desired drawing of the combustion gas to the heat exchanger.

Figure 7:
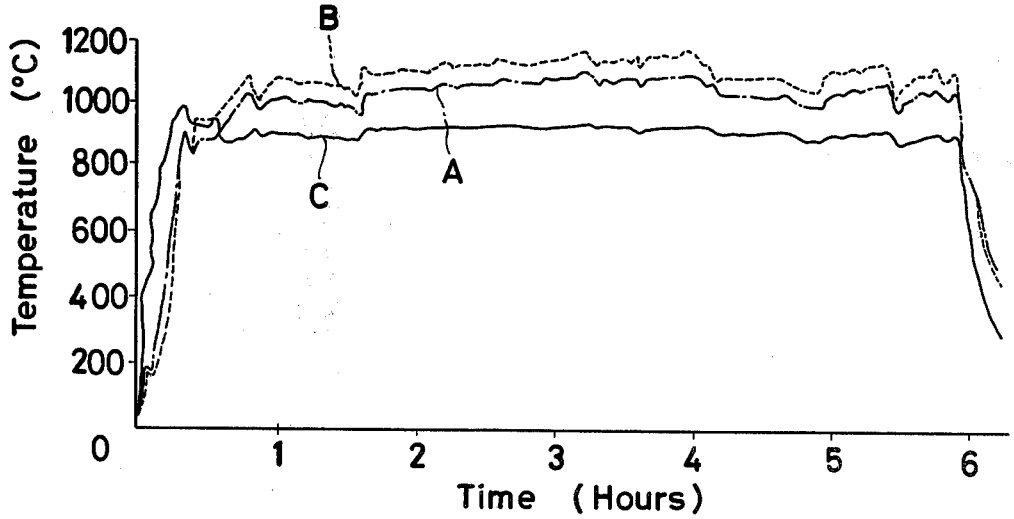

An experiment was performed with a combustion furnace having a construction like the one shown in FIG. 6 and having dimensions of 2450 mm in inside height, 1600 mm in inside diameter and 1240 mm in inside diameter of the lower section 3 of the furnace proper by placing thermocouples one each at the level of the air inlet, the medial level of the entire inside height of the furnace and the outlet, continuing the introduction of rice hulls through the inlet at a flow rate of about 4.6 kg/min and subjecting the delivered rice hulls to continuous combustion for about six hours, with the temperatures of the thermocouples measured along the course of time. The results of this experiment are shown in FIG. 7. In this graph, the curve indicated as "A" represents changing temperatures at the level of the inlet, the curve "B" those at the medial level of the inside height of the furnace and the curve "C" those at the outlet respectively.

The graph of FIG. 7 will be described more specifically. When delivered rice hulls had accumulated to a suitable amount inside the lower section 3 of the furnace proper 3, the burner 26 was ignited to set fire to the rice hulls and air was immediately blown in through the air inlet 2 at a flow rate of about 20 $Nm^3$/min and rice hulls were introduced through the inlet 11 at a rate of about 4.6 kg/min carried by a stream of air having a flow rate of about 15 $Nm^3$min. Further air was also blown in through the air perforations 9 at a flow rate of about 2 $Nm^3$/min. The burner was extinguished immediately after the rice hulls initially accumulated in the layer of burning material had ignited. After a lapse of about 20 minutes from the start of the combustion, the temperatures at the three points of measurement invariably exceeded 800° C. After a lapse of about 50 minutes, the blower 31 was set to motion to have the combustion gas drawn to the heat exchanger 31 at a rate of about 53 $Nm^3$/min. After a lapse of 100 minutes, the temperatures inside the furnace exceeded 1000° C. because the drawing speed of the blower was decreased to about 51 $Nm^3$/min. After a lapse of about four hours, the temperatures inside the furnace slightly fell because the feed rate of air was increased to about 21 $Nm^3$/min. After a lapse of about six hours, the introduction of rice hulls was discontinued. The temperatures inside the furnace and the temperature of the combustion gas then fell abruptly.

The total amount of rice hulls thus burned throughout the entire experiment was about 1760 kg, the amount of carbon discharged was about 185.5 kg and that of dust discharged was about 6.1 kg. The solid particles' content in the combustion gas released into the atmosphere was 0.037 g/$Nm^3$ and the combustion efficiency of the furnace was found to be 99.2%.

It is evident from the graph described above that once the combustion in the furnace reaches its constant state, the temperatures of the furnace interior and combustion gas are brought to substantially constant levels and enable the combustion to proceed stably thereafter and that a discontinuation of introduction of combustible materials results in an abrupt decrease in the temperatures of the furnace interior. The combustion furnace of the present invention, therefore, can be used in much the same manner as the combustion furnace operated by use of a fossil fuel.

As described above, the present invention comprises forcing an air current into a combustion furnace in a manner such that the incoming air flows in a spirally descending current along the inner wall surface of the furnace proper, causing a material subjected to combustion to be entrained by the air current into the layer of burning material, enabling the material to be dried, preheated and even partially burned en route to the layer of burning material, causing the combustion gas to ascend in a vigorous whirl in the same rotational direction as that of the spirally descending air current and allowing the solid particles such as soot and products of incomplete combustion which are entrained by the combustion gas to be hurled out into the spirally descending air current by virtue of the centrifugal force exerted by the vigorous whirl of the combustion gas.

Since the combustion proceeds as described above, the inner wall of the furnace is not exposed to direct contact with the combustion gas and, therefore, has high durability. The spirally descending air current absorbs heat from the spirally ascending combustion gas and, in the preheated state, reaches the layer of burning material, mixing an appreciable addition to the combustion efficiency of the furnace. The combustion efficiency is all the more enhanced by the fact that the material subjected to combustion is carried by this air current to the layer of burning material.

According to the present invention, desired continuous combustion can be efficiently obtained without use of either a burner or a fuel for the purpose of combustion. Moreover, the combustion gas released from the furnace into the atmosphere is substantially free from combustion dust and, therefore, has no possibility of causing air pollution. Consequently, use of the combustion furnace of this invention permits safe disposal of useless matter without entailing any environmental pollution. The clean waste gas of combustion which is thus discharged at a fixed temperature in a fixed flow volume by this combustion furnace can be advantageously utilized as the heat source in a drying unit, a heat exchanger, a boiler, etc. The combustion furnace, accordingly, makes a contribution to the energy-saving program promoted the world over.

What is claimed as new and desired to be secured by Letters Patent of the United States is:

1. A method for combustion which comprises:

continuously blowing air and combustible material into the upper section of a cylindrical furnace body, having a flue opening into the center part of the ceiling thereof, in a tangential direction relative to the furnace body thereby forming a downflowing helical stream of air and combustible material in the vicinity of the inner wall of the furnace body;

causing the air in the downflowing helical stream to strike the floor of the furnace, collect toward the center of the furnace and then reverse its direction of flow to ascend toward the flue opening through the space enclosed by the downflowing helical stream while swirling in the same direction as the downflowing helical stream;

causing the combustible material in the downflowing helical stream to strike the floor of the furnace and be carried into and burned together with a layer of burning material formed at the bottom of the furnace by previously deposited combustible material;

causing the combustion gas to ascend together with the ascending air toward the flue opening through the space enclosed by the downflowing helical stream swirling in the same direction as the downflowing helical stream;

causing the solid materials contained in the combustion gas to be hurled into the downflowing helical stream by centrifugal force and to be carried back to the layer of burning material;

agitating the layer of burning material to cause the lower part of the layer of burning material to be progressively discharged outside the furnace body; and maintaining the layer of burning material at a constant thickness.

2. The method according to claim 1, wherein the material subjected to combustion is in the form of particles having a particle size capable of being carried by said air current.

3. The method according to claim 1, which further comprises injecting air into said layer of burning material while maintaining the layer of burning material at a constant thickness.

4. A furnace for combustion comprising:

a cylindrical furnace body forming a funnel-shaped portion at a lower section thereof;

a lid covering an upper section of said furnace body, said lid being provided at the center thereof with a flue, the opening of said flue facing said furnace body and being on the same plane as said lid;

an air inlet tangentially disposed on the upper section of said furnace body;

a layer of burning material formed at said funnel-shaped portion by previously deposited combustible material;

a combustible material inlet disposed on the upper section of said furnace body at a position at which the combustible material forming the layer of burning material is carried into said funnel-shaped portion; and means for progressively discharging a lower part of said layer of burning material outside said furnace body and for maintaining said layer of burning material at a constant thickness.

5. The combustion furnace according to claim 4, wherein the air inlet is disposed in the upper section of the furnace body in a tangential direction relative to the furnace body.

6. The combustion furnace according to claim 5, wherein one common inlet is provided for the supply of air and for the introduction of the material for combustion.

7. The furnace for combustion according to claim 4 wherein said means for progressively discharging a lower part of said layer of burning material outside said furnace body and for maintaining said layer of burning material at a constant thickness comprises an agitation rod.

8. The furnace for combustion according to claim 7, wherein said agitating rod includes a plurality of air injection orifices.

9. The furnace of combustion according to claim 4 wherein said means for progressively discharging a lower part of said layer of burning material outside said furnace body and for maintaining said layer of burning material at a constant thickness further comprises air injection means for supplying air to said layer of burning material.

* * * * *